US006716315B2

(12) United States Patent
Steiner et al.

(10) Patent No.: US 6,716,315 B2
(45) Date of Patent: Apr. 6, 2004

(54) WATER DRAINING DEVICE

(75) Inventors: Karl Steiner, Herbrechtingen (DE); Robert Wolf, Herbrechtingen (DE); Hans Prinzing, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 44 days.

(21) Appl. No.: 09/758,243

(22) Filed: Jan. 12, 2001

(65) Prior Publication Data

US 2001/0010259 A1 Aug. 2, 2001

(30) Foreign Application Priority Data

Jan. 14, 2000 (DE) ..... 200 00 599
Mar. 24, 2000 (DE) ..... 100 14 873

(51) Int. Cl.[7] ..... D21F 11/00; D21F 1/66; D21F 1/48; D21F 3/00

(52) U.S. Cl. ..... 162/199; 162/190; 162/264; 162/DIG. 7; 141/364; 141/106

(58) Field of Search ..... 162/184, 190, 162/264, DIG. 7, 199; 141/364, 106

(56) References Cited

U.S. PATENT DOCUMENTS

| | | | | | |
|---|---|---|---|---|---|
| 1,423,400 | A | | 7/1922 | Cramer | |
| 2,165,549 | A | | 7/1939 | Hornbostel | |
| 2,884,061 | A | * | 4/1959 | Lee | 162/317 |
| 3,072,180 | A | * | 1/1963 | Jodrey | 162/319 |
| 3,214,327 | A | * | 10/1965 | Wicker | 139/383 A |
| 3,347,740 | A | * | 10/1967 | Goumeniouk | 134/15 |
| 3,355,350 | A | | 11/1967 | Reynolds | |
| 3,775,243 | A | * | 11/1973 | McCarrick | 100/121 |
| 4,267,017 | A | * | 5/1981 | North | 162/190 |
| 4,586,984 | A | * | 5/1986 | Laapotti | 162/205 |
| 4,686,005 | A | * | 8/1987 | Biondetti et al. | 162/190 |
| 5,487,193 | A | * | 1/1996 | Hennessy | 222/341 |
| 5,647,958 | A | * | 7/1997 | Schmidt-Rohr et al. | 162/203 |
| 5,851,358 | A | * | 12/1998 | Kade | 162/275 |
| 2002/0112837 | A1 | * | 8/2002 | Mayer et al. | 162/190 |

FOREIGN PATENT DOCUMENTS

| | | | | |
|---|---|---|---|---|
| DE | 2509057 | | 9/1976 | |
| DE | 10014873 | A1 * | 7/2001 | D21F/3/00 |
| EP | 0371786A2 | A3 | 6/1990 | |
| EP | 950756 | A2 * | 10/1999 | D21F/3/02 |
| WO | 98/44192 | | 10/1998 | |

* cited by examiner

*Primary Examiner*—José A. Fortuna
(74) *Attorney, Agent, or Firm*—Greenblum & Bernstein, P.L.C.

(57) ABSTRACT

Water draining device for a paper machine or the like, in particular for a felted press of such a paper machine, including a receiving tank extending at least essentially over the machine width. The receiving tank includes a first chamber that receives arriving water and is under ambient pressure, and a second chamber that is connected to the first chamber and is under vacuum, into which the water collecting in the first chamber is aspirated and from which the water is eventually drained. A water receiving device of improved efficiency is also provided by forming a water receiving device by at least one suction channel projecting into the wedge-shaped area between the upper press roll and the dewatering belt, and extending transverse to the pulp web, which suction channel is connected to a source of reduced pressure.

22 Claims, 4 Drawing Sheets

WATER DRAINING DEVICE

CROSS-REFERENCE TO RELATED APPLICATIONS

The present application claims priority under 35 U.S.C. § 119 of German Patent Applications No. 200 005 99.5 and No. 100 148 73.5, filed on Jan. 14, 2000, and Mar. 24, 2000, respectively, the disclosures of which are expressly incorporated by reference herein in their entirety.

BACKGROUND OF THE INVENTION

1. Field of the Invention

The invention relates to a water draining device for a paper machine or the like, in particular for a felted press of paper machines having a receiving tank extending at least essentially over the machine width. Moreover it relates to a press arrangement for dewatering a pulp web.

2. Discussion of Background Information

In previous conventional water draining devices, the press water is ordinarily drained by gravity. However, when used for a top felt, the amount of water thrown off into the tank cannot, in each situation, flow laterally to the edge of the tank by gravity. In particular, when the discharge cross-section of the tank is too small and/or the tank is not inclined sufficiently, water can flow back onto the felt.

From DE 25 09 057 C3, a suction box has already become known for sucking off water that passes through a wire, with the box being divided into a water suction chamber and an air suction chamber by means of a partition provided with apertures.

SUMMARY OF THE INVENTION

The present invention relates to creation of an improved water draining device in which it is possible to reduce a discharge cross-section of the tank accompanied by a corresponding saving of space without any problems. In addition, the present invention renders it impossible for water to flow back onto a felt in a paper machine. Furthermore, the present invention enables drainage, with only a very slight incline in the transverse direction, of water amounts that collect, without any problems.

The present invention further relates to a receiving tank including a first chamber that receives arriving water and is under ambient pressure, and a second chamber that is connected to the first chamber and is under vacuum, into which water collecting in the first chamber is sucked and from which the water is eventually drained.

The water draining device of the invention can be used with particular advantage in a press arrangement serving to dewater a pulp web, in particular, a paper or cardboard web, and having at least one elongated press nip in the web travel direction, since an increased volume of water must be taken into account with an elongated press nip.

It is advantageous for at least one of the first chamber and the second chamber to extend at least essentially over the entire machine width.

The first chamber and the second chamber are preferably connected to one another via several apertures distributed over the machine width.

It is also advantageous if the water is drained from the second chamber on at least one of the two machine sides.

In a preferred practical form of embodiment of the water draining device according to the present invention, the two chambers are connected to one another by throttling apertures.

The average direction of flow, i.e., the effective main flow direction of the water flow prevailing in the first chamber, can be at least substantially free of cross-flow.

On the other hand, the average direction of flow, i.e., the effective main flow direction of the water flow prevailing in the second chamber, can have a cross component running in the direction of the machine width.

In a preferred aspect of the invention, the first chamber and the second chamber are connected to one another by at least one pipe, whose one end opens in a respective connecting aperture in a partition provided between the first chamber and the second chamber and whose other end opens into the second chamber. Preferably, several pipes are distributed over the machine width. For example, 0.5 to 5 pipes can be provided per meter.

Preferably, the pipes have a diameter of about 10 to about 100 mm.

The vacuum of the second chamber is preferably smaller than about 0.2 bar, more preferably the vacuum of the second chamber is smaller than or equal to about 0.05 bar.

In one practical aspect of the water draining device of the present invention, the second chamber is limited by a pipe under vacuum that extends in the transverse direction and whose jacket is provided with apertures, via which the first chamber is connected to the second chamber formed by the interior of the pipe.

The receiving tank can be divided into segments over the machine width, or it can be constructed so as to be continuous over the machine width.

The vacuum prevailing in the second chamber is preferably produced by a volumetric pump.

The water can be sucked off from the tank or channel, for example, as in dry cylinders, or like the oil in NFP presses.

A small amount of air, e.g., a few liters per second (l/s), can also be sucked off through the suction apertures. Thus, for example, at a suction aperture diameter of D=5 mm and a pressure difference Dp=5,000 $N/m^2$, a volume flow V-air of substantially less than 0.5 $m^3$/min can result.

The water draining device of the invention can advantageously be used with a felted press, in particular, a single- or double-felted press, and, in particular, for a press arrangement having at least one longitudinal nip.

The present invention also relates to a press arrangement for dewatering a pulp web, in particular a paper, cardboard, or tissue web, in a machine for its production and/or finishing, composed of at least one press nip formed by two press rolls arranged approximately above one another and pressed against one another, through which, in addition to the pulp web, at least one dewatering belt running above the pulp web to receive the expressed water is conducted, whereby a water receiving device is arranged between the upper press roll and the dewatering belt.

The water thrown off thereby from the usually grooved and/or blind-bored press rolls, must be collected after the press nip and be drained. Otherwise, most of the thrown-off water is absorbed by the continuously revolving dewatering belts, which in particular with the upper dewatering belt, leads to a re-wetting of the pulp web. Water channels that receive and drain the thrown-off water generally serve this purpose.

In particular in cases in which the upper dewatering belt leaves the press nip approximately horizontally or even on an upward incline, however, the water channel can not be positioned sufficiently close to the press nip. As a result, only a relative small portion of the water thrown off from the upper press roll can be collected. The remainder predominantly reaches the upper dewatering belt, which then leads to considerable re-wetting of the pulp web, as already mentioned.

The present invention therefore also relates to improving the efficiency of the water receiving device of press arrangements. In this regard, the water receiving device can be formed by at least one suction channel projecting into the wedge-shaped area between the upper press roll and the dewatering belt and running transverse to the pulp web, which channel is connected to a source of reduced pressure. By using a suction channel, considerably more water can be drained than with a water channel. This is particularly true for press arrangements with an upper dewatering belt that runs approximately horizontally or even on an upward incline after the press nip. The reason for this is, in particular, that the suction channel can be led very far into the wedge-shaped area and the reduced pressure draws a great deal of water into the suction channel.

To encompass the main direction of the thrown-off water, it is sufficient for the suction channel to have a gap width of 1 to 50 mm, preferably 2 to 7 mm, at least in its initial zone. A certain minimum reduced pressure is required in the suction channel for the collected water to overcome the difference in height, particularly with a suction channel inclined upwards. The reduced pressure in the suction channel should therefore be between 50 and 80,000 $N/m^2$, preferably between 10,000 and 30,000 $N/m^2$. Combined with the target gap widths, these reduced pressure values hold the energy for producing the reduced pressure within reasonable limits. At the same time, it is also guaranteed that the water can be conducted into a collecting tank, which may under certain circumstances be at a higher level, for receiving and transporting away the sucked water. A simple design for connecting the suction channel to a source of reduced pressure can be achieved if the mouth of the suction channel lies above the maximum water level in the collecting tank and the collecting tank has a connection for a source of reduced pressure above the maximum water level. The collecting tank can also be divided into several chambers transverse to the pulp web, each with a separate connection for a source of reduced pressure. This enables the reduced pressure to be controlled, preferably equalized, over the width of the pulp web.

As far as the cost of production is concerned, it is furthermore advantageous if the suction channel is formed by an upper and a lower channel wall running transverse to the pulp web. In order to capture the majority of the thrown-off water thereby, the channel walls preferably run at an acute angle to the dewatering belt, at least in the initial zone of the suction channel.

Depending on the speed of the web, the amount of thrown-off water, and the nature of the dewatering belt, the edge of the lower channel wall is preferably arranged as close to the dewatering belt as possible, whereby the distance should preferably be less than 20 mm. The edge can even touch the dewatering belt or be immersed in it slightly. If the edge of the lower channel wall comes into contact with the dewatering belt, it should advantageously be constructed as a wear-resistant strip. The strip thereby preferably forms an angle of between 10 and 45° with the dewatering belt.

In order to be able also to capture the water thrown off above the suction channel in the direction of rotation of the upper press roll, a water capture device should adjoin the suction channel as a part of the water receiving device. The design is simplified if the upper channel wall is itself part of the water capture device. Moreover, the surface of the upper channel wall lying outside the suction channel preferably runs at an incline to the press nip and the edge of the upper channel wall preferably projects into the wedge-shaped area at least slightly less than the edge of the lower channel wall. The result of this is that the water captured by the outside surface of the upper channel wall runs back in the direction of the press nip and can drip from the upper edge onto the longer lower channel wall of the suction channel. From there, this water is drained via the suction channel into the collecting tank. The water capture device arranged above the suction channel can also have its own collecting basin, however, with an outlet for the captured water.

It can also be advantageous, however, for the upper channel wall to be longer, so that it projects into the wedge-shaped area exactly as far as or further than the lower channel wall. This increases the effect of the reduced pressure on the dewatering belt.

The distance between the upper channel wall and the upper press roll preferably is a multiple of the gap width of the suction channel, so that the wedge-shaped area is not ventilated at too high a speed.

It is possible to use the water receiving device with a great variety of press arrangements. For example, a dewatering belt can also run through the press nip below the pulp web and the press nip can be elongated by using a shoe press roll.

Expanding upon the above, the present invention is directed to a water draining device comprising a receiving tank, the receiving tank including a first chamber under ambient pressure and capable of receiving arriving water, and a second chamber connected to the first chamber, the second chamber being connectable to a vacuum source so that the second chamber can be placed under vacuum for aspirating water collecting in the first chamber into the second chamber, and the second chamber including at least one drain from which water can be drained from the second chamber.

Moreover, the present invention is directed to a combination of a water draining device and a paper machine, the paper machine having a machine width, and the draining device extending at least substantially over the machine width.

Still further, the present invention is directed to a method of draining water from a press arrangement serving to dewater a pulp web, such as a paper or cardboard web, which includes at least one elongated press nip in a direction of web travel, comprising positioning a water draining device adjacent the press arrangement, the water draining device comprising a receiving tank, the receiving tank including a first chamber under ambient pressure, and a second chamber connected to the first chamber and to a vacuum source, and the second chamber including at least one drain; receiving water in the first chamber; drawing a vacuum on the second chamber to aspirate water collecting in the first chamber into the second chamber; and draining water through the at least one drain from the second chamber.

Still further, the present invention is directed to, in combination, a water draining device and a paper machine; the water draining device comprising a receiving tank, the receiving tank including a first chamber under ambient pressure and capable of receiving and collecting arriving water under ambient pressure, and a second chamber connected to the first chamber, the second chamber being connectable to a vacuum source so that the second chamber can be placed under vacuum for aspirating water collecting in the first chamber into the second chamber with the first chamber and the second chamber being constructed and arranged so that a level of water in the second chamber is higher than a level of water in first chamber, and the second chamber including at least one drain from which water can be drained from the second chamber; the paper machine having a machine width; and the draining device extending at least substantially over the machine width.

Still further, the present invention is directed to a method of draining water from a press arrangement serving to dewater a pulp web which includes at least one elongated press nip in a direction of web travel, comprising positioning a water draining device adjacent the press arrangement, the water draining device comprising a receiving tank, the receiving tank including a first chamber under ambient pressure, and a second chamber connected to the first chamber and to a vacuum source, and the second chamber including at least one drain; receiving and collecting water under ambient pressure in the first chamber; drawing a vacuum on the second chamber to aspirate water collecting in the first chamber into the second chamber so that a level of water in said second chamber is higher than a level of water in said first chamber; and draining water through the at least one drain from the second chamber.

The water draining device can be associated with a felted press of the paper machine.

At least one of the first chamber and the second chamber can extend at least substantially over the machine width.

Apertures can be distributed over the machine width, with the apertures connecting the first chamber and the second chamber.

The second chamber can include two machine sides, and the at least one drain can be on at least one of the two machine sides of the second chamber.

Throttling apertures can connect the first chamber and the second chamber.

The average direction of flow of water flow in the first chamber can be at least substantially free of cross-flow.

The average direction of flow in the second chamber can have a cross component running in a machine width direction.

At least one pipe can connect the first chamber and the second chamber, and the at least one pipe can include two open ends. A partition including connecting apertures can be between the first chamber and the second chamber. Moreover, one open end of the at least one pipe can open in a respective connecting aperture and the other open end can open into the second chamber. The at least one pipe can comprise a plurality of pipes distributed over the machine width. The plurality of pipes can comprise about 0.5 to 5 pipes per meter, and can have a diameter of about 10 to about 100 mm.

The vacuum in the second chamber can be less than about 0.2 bar, and preferably the vacuum in the second chamber is less than or equal to about 0.05 bar.

The second chamber can be formed by an interior of a transversely extending pipe under vacuum, and the pipe can include a jacket having apertures connecting the first chamber and the second chamber.

The receiving tank can be divided into segments over the machine width, or the receiving tank can be constructed so as to be continuous over the machine width.

A volumetric pump can produce the vacuum in the second chamber.

Still further, the present invention is directed to a press arrangement for dewatering a pulp web in a machine for at least one of production and finishing of a pulp web, comprising at least one press nip formed by a lower press roll and an upper press roll arranged approximately above and pressed against the lower press roll; at least one dewatering belt adapted to run above the pulp web through the at least one press nip, and to receive water expressed from the pulp web; and a water receiving device positioned between the upper press roll and the at least one dewatering belt, the water receiving device comprising at least one suction channel projecting into a wedge-shaped area between the upper press roll and the at least one dewatering belt and extending along the at least one press nip to be transverse to the pulp web, and a connection to connect the at least one suction channel to a source of reduced pressure.

The at least one suction channel can have a gap width of 1 to 50 mm at least in an initial zone of the at least one suction channel, and preferably the at least one suction channel has a gap width of 2 to 7 mm at least in an initial zone of the at least one suction channel.

Moreover, at least in an initial zone of said at least one suction channel, there is a reduced pressure of 50 to 80,000 $N/m^2$, and preferably a reduced pressure of 10,000 to 30,000 $N/m^2$.

A collecting tank can be connected to the at least one suction channel, with the collecting tank receiving and transporting away water aspirated into the at least one suction channel.

The at least one suction channel can include a mouth which is positioned above a maximum water level of the collecting tank, and the collecting tank can include the connection to connect the at least one suction channel to the source of reduced pressure, with the connection being positioned above the maximum water level.

The at least one suction channel can comprise an upper channel wall and a lower channel wall extending along the at least one press nip to run transverse to the pulp web, with the upper channel wall and the lower channel wall extending at an acute angle to the at least one dewatering belt at least in an initial zone of the suction channel.

The lower channel wall can include an edge, and the edge can be positioned close to the at least one dewatering belt, such as less than 20 mm from the at least one dewatering belt, or the edge can touch or be immersed in the at least one dewatering belt. The edge of the lower channel wall can comprise a wear-resistant strip, and the strip can form an angle of between 10 and 45° with the at least one dewatering belt.

The upper channel wall can be part of a water capture device for water thrown off from the upper press roll above the at least one suction channel.

The upper channel wall can include a surface of the at least one suction channel outside the at least one suction channel, with the surface extending at an incline to the at least one press nip, and the upper channel wall can include an edge projecting into the wedge-shaped area at least slightly less than an edge of the lower channel wall.

The upper channel wall can include an edge projecting into the wedge-shaped area exactly as far as or further than the lower channel wall.

The collecting tank can be divided into a plurality of chambers extending along the at least one press nip and transverse to the pulp web, with each of the plurality of chambers including a connection for the source of reduced pressure.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention is explained in more detail below based on embodiments with reference to the drawings, in which.

DETAILED DESCRIPTION OF THE PRESENT INVENTION

Figure 1:
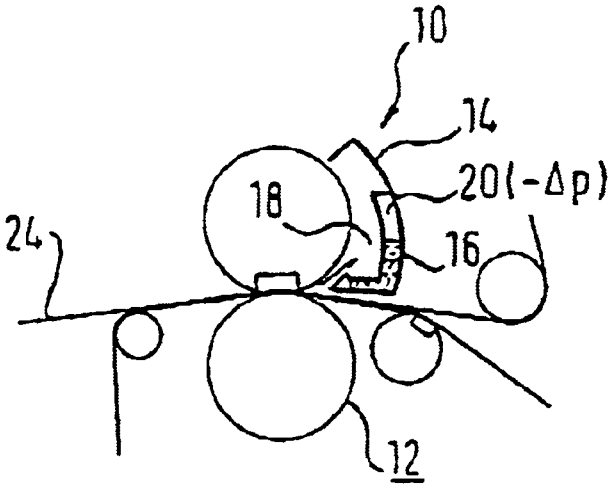
FIG. 1 shows a schematic representation of a water draining device assigned to the top felt of a double-felted press.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1 to 9 respectively show in purely schematic representation a water draining device 10 for a paper machine and the like that can be used in particular for a felted press 12. In the case of a double-felted press, see, for example, FIGS. 1 and 3, such a water draining device 10 can be particularly used for the top felt.

The water draining device 10 includes in each case a receiving tank 14 extending at least essentially over the machine width. This receiving tank 14 has in each case a first chamber 18 that receives the arriving water 16 and is under ambient pressure, and a second chamber 20 that is connected to the first chamber and is under vacuum, into which the water 16 collecting in the first chamber 18 is sucked, and from which the water 16 is eventually drained.

At least one of the two chambers 18, 20 can extend at least essentially over the machine width.

The two chambers 18, 20 can be connected via apertures 22 distributed over the machine width. The water can be drained from the second chamber 20 on at least one of the two machine sides. The apertures 22 can be for example throttling apertures.

Figure 2:
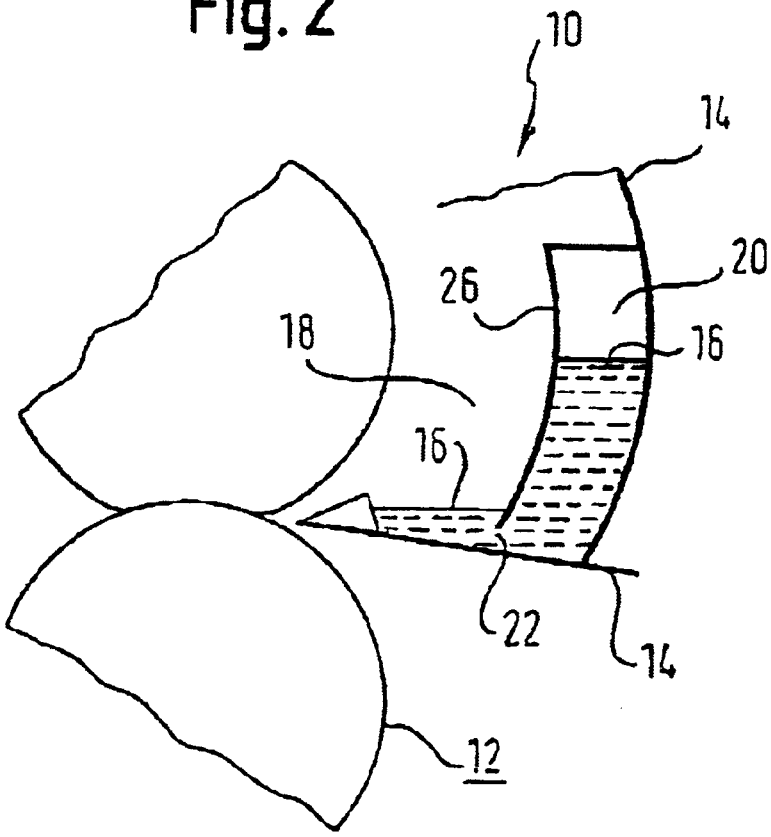
FIG. 2 shows an enlarged representation of the water draining device shown in FIG. 1.

As an example, in the embodiment shown in FIGS. 1 and 2 the water draining device 10 is assigned to the top felt 24 of a double-felted shoe press 12. The connecting apertures 22 are provided in a lower area adjacent to the wire 24. A partition 26, in which apertures 22 are left, is provided between the two chambers 18, 20. Water 16 collecting in the first chamber 18 travels through these apertures 22 into the second chamber 20, which is under vacuum.

Figure 3:
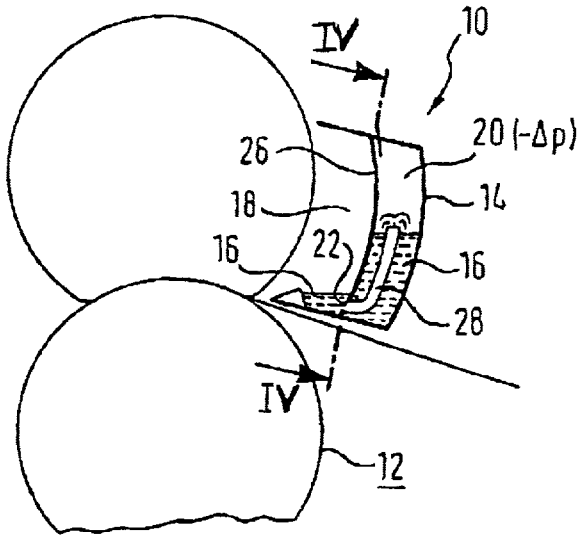
FIG. 3 shows a schematic representation of a further form of embodiment of water draining device with pipes connecting the two chambers.
Figure 4:
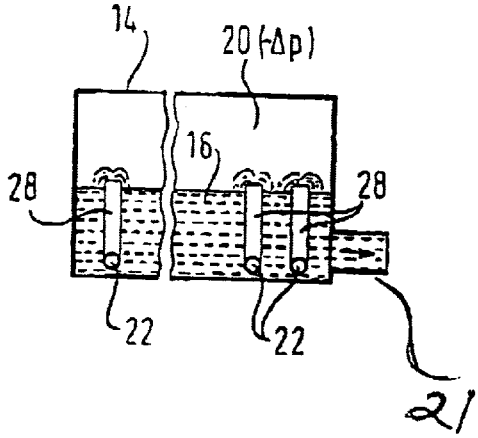
FIG. 4 shows a schematic representation in partial cross-section of the water draining device shown in FIG. 3, along line IV—IV of FIG. 3.

FIGS. 3 and 4 show in schematic representation a further form of embodiment of the water draining device 10 in which the two chambers are connected via several pipes 28 distributed over the machine width. One end of these pipes 28 opens respectively in a respective connecting aperture 22 of the partition 26 and their other end opens in the second chamber 20. As can be seen in particular from FIG. 3, the pipes are first conducted into the second chamber 20 for a distance in the area of the apertures 22 and are then generally bent upwards. The upper pipe openings are affected by the vacuum prevailing in the second chamber 20, so that water is first sucked upwards through the pipes 28 and then flows downwards in this chamber 20 through drain 21.

As can be seen in particular from FIG. 4, the water can be drained laterally from the second chamber 20 in order that the water can be drained from at least one drain 21 positioned on an edge of the chamber 20.

Figure 5:
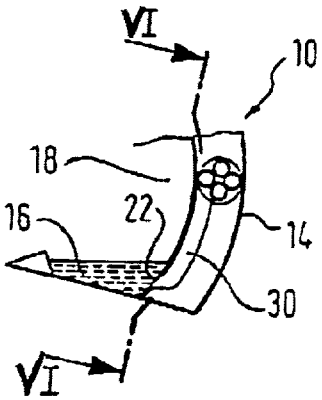
FIG. 5 shows a schematic representation of a further form of embodiment of a water draining device with pipes draining the water to the edge of the paper machine.
Figure 6:
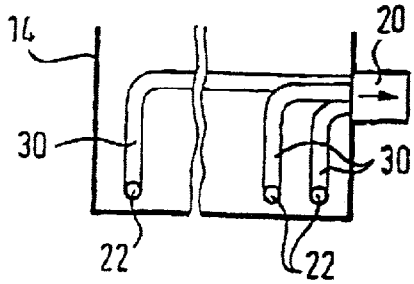
FIG. 6 shows a schematic representation in partial cross section of the water draining device shown in FIG. 5, along line VI—VI of FIG. 5.

In FIGS. 5 and 6, a schematic representation of a further form of embodiment of a water draining device 10 is shown that is provided with pipes 30 draining the water 16 to the edge of the paper machine.

Figure 7:
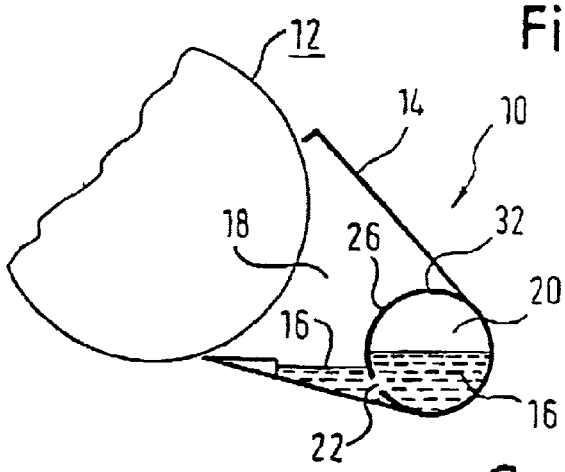
FIG. 7 shows a schematic representation of a further form of embodiment of a water draining device, in which the second chamber is limited by pipe extending in the transverse direction, FIG. 8 Shows a schematic representation of a further form of embodiment of water draining device, in which the speed of the spray water is utilized to drain the water, as in a suction spout siphon.

In the form of embodiment according to FIG. 7, the second chamber 20 is formed by a pipe 32 under vacuum that extends in the transverse direction. Apertures 22 are formed in the jacket of the pipe, and the first chamber 18 is connected to the second chamber 20 formed by the pipe interior through the apertures 22.

Figure 8:
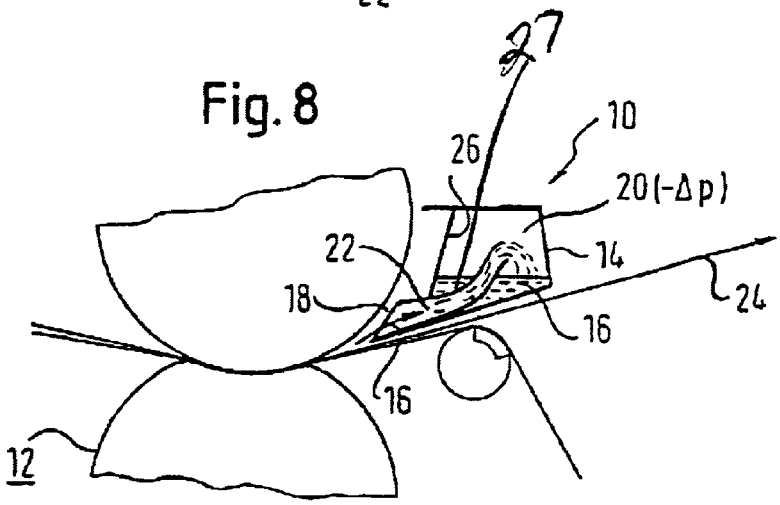

In the form of embodiment shown in FIG. 8, the speed of the spray water 16 is utilized to drain the water, as in a suction spout siphon 27. Here too, the water is again sucked into the second chamber 20 and drained via this chamber.

In the case of the embodiment illustrated in FIG. 8, the water draining device is again preferably assigned to the top felt 24 of a double-felted press.

Figure 9:
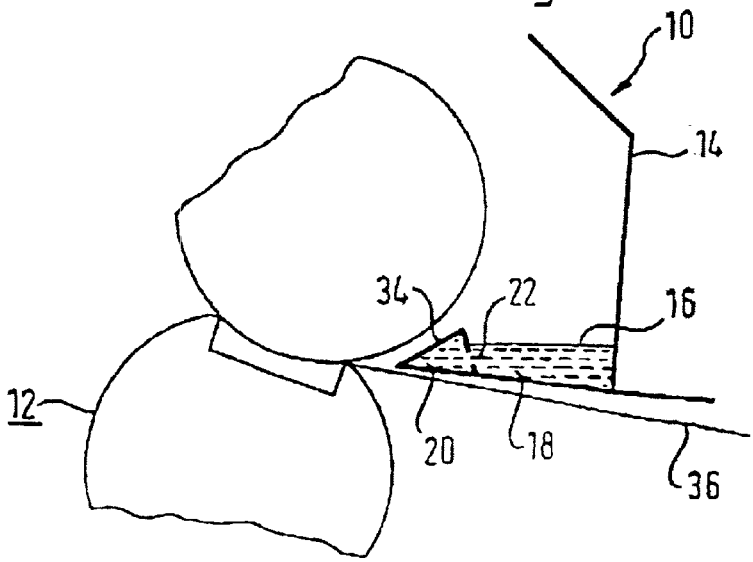
FIG. 9 shows a schematic representation of a further form of embodiment of a water draining device, in which the water is drained via a suction pipe.

In the form of embodiment shown in FIG. 9, the water is drained via a suction pipe 34, by means of which in the present case the second chamber 20 is formed and limited. The jacket of the suction pipe 34 is provided with apertures 22 via which the interior of the pipe forming the second chamber 20 is connected to the first chamber 18. The water 16 collecting in the first chamber 18 is thus sucked via the apertures 22 into the pipe 20 and is drained via this pipe.

In the present case the water draining device 10 is assigned to a single-felted shoe press 12. The water draining device 10 is arranged thereby in the outflow wedge-shaped area between the felt 36 and the upper roll.

Figure 10:
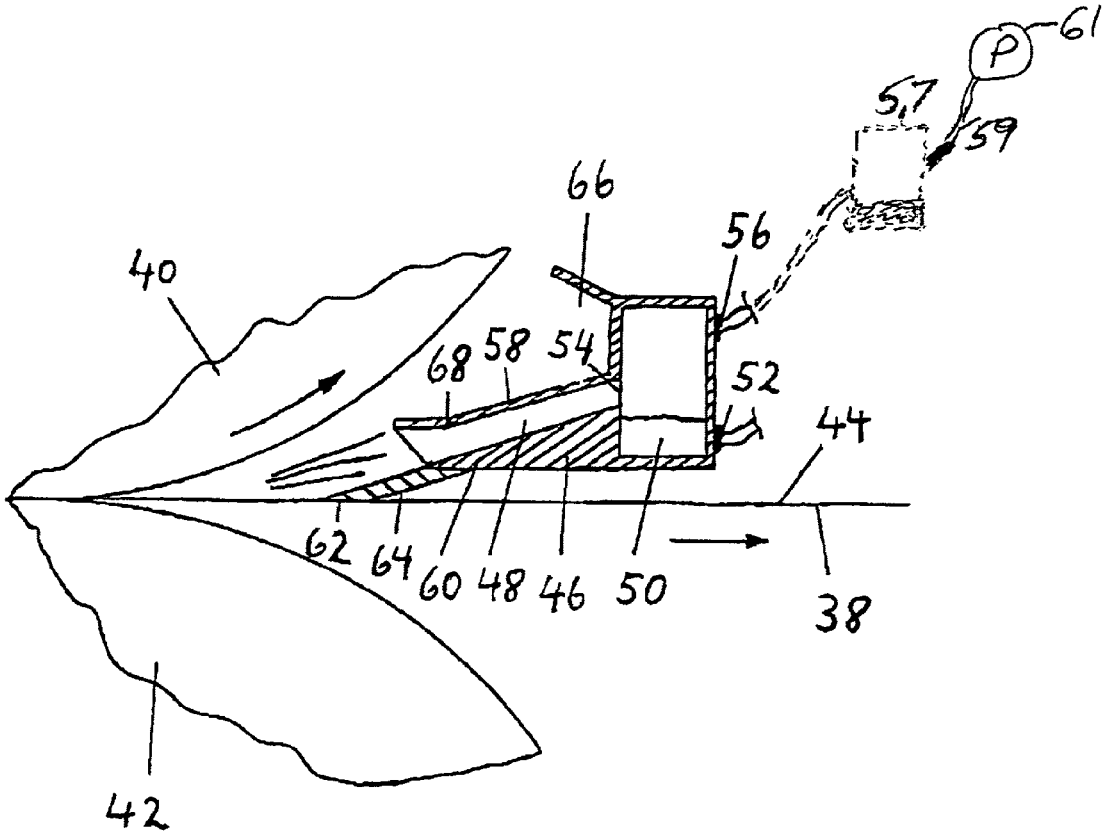
FIG. 10 shows a schematic representation in partial cross-section of a further example of an embodiment of a water receiving device.

The press arrangement of the invention is explained in more detail below based on an exemplary embodiment, whereby reference is made to FIG. 10, which shows a schematic cross-section through a water receiving device.

The press arrangement is composed of a press nip for dewatering the pulp web 38, which nip is formed by two press rolls 40, 42 that are arranged above one another and pressed against one another. In addition to the pulp web 38, a dewatering belt 44 in the form of a press felt is conducted through the press nip on each side respectively to receive the expressed water.

The press rolls 40, 42 are blind-bored and grooved, as a result of which they take up a relatively large amount of water in the press nip, which is then thrown off again after the press nip. In order to prevent the water thrown off from the upper press roll 40 from reaching the upper dewatering belt 44 to a relatively great extent, which would lead to a considerable re-wetting of the pulp web 38, a water receiving device 46 is arranged between the upper press roll 40 and the upper dewatering belt 44.

This water receiving device 46 is essentially formed from a suction channel 48 projecting into the wedge-shaped area between the upper press roll 40 and the dewatering belt 44 and running transverse to the pulp web 38, which channel is connected to a source of reduced pressure.

Even with the horizontal course of the upper dewatering belt 44 shown here, the suction channel 48 allows an efficient capture and draining of the majority of the water thrown off from the upper press roll 40. The suction channel 48 has a gap width of approximately 4 mm thereby between the upper channel wall 58 and the lower channel wall 60. The suction channel 48 leads into a collecting tank 50 for receiving and transporting away the sucked water via an outlet 52. For the water to overcome the upward incline of the suction channel 48, a reduced pressure of about 20,000 $N/m^2$ prevails in the suction channel 48. The upward incline of the suction channel 48 results in particular from the fact that the mouth 54 of the suction channel 48 lies above the maximum water level in the collecting tank 50. To produce the reduced pressure in the suction channel 48, the collecting tank 50 likewise has a connection 56 for a source of reduced pressure above the maximum water level.

The suction channel 48 itself is formed by an upper channel wall 58 and a lower channel wall 60, respectively, running transverse to the pulp web 38, whereby the channel walls 58, 60 run at an acute angle to the dewatering belt 44, at least in the initial zone of the suction channel 48. In order to be able to capture as much thrown-off water as possible thereby and even to be able to scrape it from the dewatering belt 44, the edge 62 of the lower channel wall 60 touches the dewatering belt 44 or is immersed in it slightly. Therefore, the edge 62 of the lower channel wall 60 is preferably formed by a wear-resistant ceramic strip 64.

To capture the majority of the thrown-off water, the channel walls 58, 60 and the strip 64 form an angle of about 15° with the upper dewatering belt 44.

In order to be able to capture the water thrown off above the suction channel 48 in the direction of rotation of the upper press roll 40, a water capture device 66 is arranged above the suction channel 48. The upper channel wall 58 here is part of the water capture device 66, whereby the surface of the upper channel wall 58 lying outside the suction channel 48 runs at an incline to the press nip and the edge 68 of the upper channel wall 58 projects into the wedge-shaped area slightly less than the edge of the lower channel wall 60 formed by the edge 62 of the strip 64. The result of this is that the water captured by the outer surface of the upper channel wall 58 and flowing back can drip from the edge 68 of the upper channel wall 58 onto the lower channel wall 60, from where it is drained via the suction channel 48 into the collecting tank 50.

Depending on the installation space available, the amount of water collecting, and the entire design, it is also possible for the connection 56 to lead into another, preferably higher, collecting tank 57 (shown in dotted lines) that is connected through connection 59 to the source of reduced pressure. Moreover, a vacuum can be produced by a volumetric pump 61.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE LIST

10 Water draining device
12 Felted press
14 Receiving tank
16 Water
18 First chamber
20 Second chamber
21 Drain
22 Apertures
24 Felt
26 Partition
27 Suction spout siphon
28 Pipe
30 Pipe
32 Pipe
34 Suction pipe
36 Felt
38 Pulp web
40 Upper press roll
42 Lower press roll
44 Dewatering belt
46 Water receiving device
48 Suction channel
50 Collecting tank
52 Outlet
54 Mouth
56 Connection
57 Collecting Tank
58 Upper channel wall
59 Connection
60 Lower channel wall
61 Volumetric pump
62 Edge
64 Strip
66 Water capture device
68 Edge

What is claimed is:

1. In combination, a water draining device and a paper machine;

said water draining device comprising a receiving tank, said receiving tank including a first chamber under ambient pressure and capable of receiving and collecting arriving water under ambient pressure, and a second chamber connected to said first chamber, said second chamber being connectable to a vacuum source so that said second chamber can be placed under vacuum for aspirating water collecting in the first chamber into said second chamber with said first chamber and said second chamber being constructed and arranged so that a level of water in said second chamber is higher than a level of water in said first chamber, and said second chamber including at least one drain from which water can be drained from said second chamber;

said paper machine having a machine width; and said draining device extending at least substantially over the machine width.

2. The combination according to claim 1 wherein the water draining device is associated with a felted press of said paper machine.

3. The combination according to claim 1 wherein at least one of said first chamber and said second chamber extends at least substantially over the machine width.

4. The combination according to claim 3 including apertures distributed over the machine width, said apertures connecting said first chamber and said second chamber.

5. The combination according to claim 1 including apertures distributed over the machine width, said apertures connecting said first chamber and said second chamber.

6. The combination according to claim 1 wherein said second chamber includes two machine sides, and said at least one drain is on at least one of the two machine sides of said second chamber.

7. The combination according to claim 1 including throttling apertures connecting said first chamber and said second chamber.

8. The combination according to claim 1 wherein an average direction of flow of water flow in said first chamber is at least substantially free of cross-flow.

9. The combination according to claim 8 wherein an average direction of flow in said second chamber has a cross component running in a machine width direction.

10. The combination according to claim 1 wherein an average direction of flow in said second chamber has a cross component running in a machine width direction.

11. The combination according to claim 1 including at least one pipe connecting said first chamber and said second chamber, said at least one pipe including two open ends; a partition between said first chamber and said second chamber including connecting apertures; and one open end of said at least one pipe opening in a respective connecting aperture and the other open end opening into said second chamber.

12. The combination according to claim 11 wherein said at least one pipe comprises a plurality of pipes distributed over the machine width.

13. The combination according to claim 12 wherein said plurality of pipes comprises about 0.5 to 5 pipes per meter.

14. The combination according to claim 11 wherein said at least one pipe has a diameter of about 10 to about 100 mm.

15. The combination according to claim 1 wherein the vacuum in said second chamber is less than about 0.2 bar.

16. The combination according to claim 15 wherein the vacuum in said second chamber is less than or equal to about 0.05 bar.

17. The combination according to claim 1 wherein said second chamber is formed by an interior of a transversely extending pipe under vacuum, said pipe including a jacket having apertures connecting said first chamber and said second chamber.

18. The combination according to claim 1 wherein said receiving tank is divided into segments over the machine width.

19. The combination according to claim 1 wherein said receiving tank is constructed so as to be continuous over the machine width.

20. The combination according to claim 1 including a volumetric pump producing the vacuum in said second chamber.

21. A method of draining water from a press arrangement serving to dewater a pulp web which includes at least one elongated press nip in a direction of web travel, comprising:

positioning a water draining device adjacent the press arrangement, the water draining device comprising a receiving tank, the receiving tank including a first chamber under ambient pressure, and a second chamber connected to the first chamber and to a vacuum source, and the second chamber including at least one drain;

receiving and collecting water under ambient pressure in the first chamber;

drawing a vacuum on said second chamber to aspirate water collecting in the first chamber into the second chamber so that a level of water in the second chamber is higher than a level of water in the first chamber; and draining water through the at least one drain from the second chamber.

22. The method according to claim 21 wherein the pulp web comprises a paper or cardboard web.

* * * * *